US010071888B2

(12) United States Patent
Guidry

(10) Patent No.: US 10,071,888 B2
(45) Date of Patent: Sep. 11, 2018

(54) ALARM SYSTEMS AND METHODS FOR PREVENTING IMPROPER LIFTING OF TUBULAR MEMBERS

(71) Applicant: Frank's International, LLC, Houston, TX (US)

(72) Inventor: Mark Guidry, Lafayette, LA (US)

(73) Assignee: Frank's International, LLC, Houston, TX (US)

( * ) Notice: Subject to any disclaimer, the term of this patent is extended or adjusted under 35 U.S.C. 154(b) by 0 days.

(21) Appl. No.: 15/590,517

(22) Filed: May 9, 2017

(65) Prior Publication Data

US 2017/0247234 A1 Aug. 31, 2017

Related U.S. Application Data

(63) Continuation of application No. 13/573,747, filed on Oct. 4, 2012.

(51) Int. Cl.
*B66C 15/06* (2006.01)
*E21B 19/24* (2006.01)
*E21B 19/16* (2006.01)

(52) U.S. Cl.
CPC ..... *B66C 15/065* (2013.01); *E21B 19/165* (2013.01); *E21B 19/24* (2013.01)

(58) Field of Classification Search
None
See application file for complete search history.

(56) References Cited

U.S. PATENT DOCUMENTS

| | | | | |
|---|---|---|---|---|
| 4,141,454 | A * | 2/1979 | Long, Jr. | B66C 23/90 212/195 |
| 5,058,752 | A * | 10/1991 | Wacht | B66C 23/90 212/231 |
| 8,695,692 | B2 * | 4/2014 | Laing | E21B 44/00 166/250.01 |
| 2005/0257933 | A1 * | 11/2005 | Pietras | E21B 19/07 166/380 |
| 2007/0131416 | A1 * | 6/2007 | Odell, II | E21B 19/06 166/250.1 |
| 2009/0151934 | A1 * | 6/2009 | Heidecke | E21B 3/02 166/250.01 |
| 2011/0174483 | A1 * | 7/2011 | Odell, II | E21B 19/06 166/250.01 |

* cited by examiner

*Primary Examiner* — Firmin Backer
*Assistant Examiner* — Shawna M Kingston
(74) *Attorney, Agent, or Firm* — Ted M. Anthony

(57) ABSTRACT

Systems and methods for preventing improper lifting of tubular members are described, in which sensing devices are used to detect when a tubular reaches a selected position within a lifting device suitable for engagement, and/or to detect when a lifting operation is initiated that would exceed the capacity of a lifting device. Operators are engaged with the tubular member and provided with a preselected force corresponding to the weight of one or more tubular members, such that when the weight of a lifting operation exceeds the preselected force, an audible device may be actuated responsive to sensor output, to immediately alert individuals, such that the improper lifting operation may be halted. Similarly, an audible device may be actuated responsive to sensor output when a tubular member reaches a selected position within the lifting device, such that additional movement may be ceased.

18 Claims, 6 Drawing Sheets

ALARM SYSTEMS AND METHODS FOR PREVENTING IMPROPER LIFTING OF TUBULAR MEMBERS

CROSS REFERENCES TO RELATED APPLICATIONS

This application is a continuation of U.S. patent application Ser. No. 13/573,747, filed Oct. 4, 2012, currently pending, incorporated herein by reference.

STATEMENTS AS TO THE RIGHTS TO THE INVENTION MADE UNDER FEDERALLY SPONSORED RESEARCH AND DEVELOPMENT

None

BACKGROUND OF THE INVENTION

1. Field of Invention

Embodiments within the present disclosure relate, generally, to systems and methods for preventing improper lifting of tubular members through use of alarms responsive to the weight applied during a lifting operation, the position of a tubular member within a lifting device, or combinations thereof.

2. Background

When assembling a string of tubular members, such as a drill string or casing string, a lifting device, such as an overshot-type casing running tool, normally in conjunction with an elevator or similar gripping apparatus, is engaged with an individual tubular member, then used to move and/or rotate the tubular member to engage the tubular member with an adjacent portion of the tubular string. The lifting device is then disengaged from the tubular string, and the process is repeated. Similarly, when disassembling a string of tubular members, a single member of a tubular string may be engaged by a lifting device, rotated to disengage the tubular member from the string, then lifted and/or otherwise moved.

Conventionally, when engaging a lifting and/or running tool with a tubular member, one or more individuals on a rig floor and/or one or more other visual indicators are used to provide a signal to an operator when the tubular member reaches the correct position within the lifting device for engagement. If an operator continues to move the lifting device after this position has been reached, an improper engagement may result, and/or the lifting device may forcibly contact the tubular member, causing damage to the lifting device and/or the tubular member.

When performing assembly and/or disassembly operations, operator must repetitively perform a sequence of steps that include engaging tubular members with a lifting device, lifting and/or moving the tubular members, torquing the tubular members, disengaging the lifting device, and then repeating the process with subsequent tubular members. Due to the repetitive nature of such an undertaking, it is common for an operator to inadvertently skip one or more of these steps, or to lose awareness of the most recent action that was performed. Incomplete torquing of a tubular connection during disassembly may also create difficulty. As a result, it is possible to exceed the maximum lifting capacity of a lifting device by inadvertently attempting to lift multiple connected tubular members at one time. While some systems include visible signals that are provided when an improper lifting operation is undertaken, these signals are often overlooked, especially during situations in which the initial error resulted from operator inattention.

For example, during casing running procedures, a single common load is handled by two operators: a driller responsible for the rig, and the operator of the casing running tool. During casing running operations, the load must be transferred from an elevator or similar lifting apparatus having a limited capacity to the casing running tool. If any miscommunications occur between operators, or if any operations are performed improperly, loads exceeding the capacity of the equipment may be inadvertently applied.

A need therefore exists for systems and methods for preventing improper lifting of tubular members that instantly and effectively alerts operators, and other personnel at a work site, before damage may be incurred through an improper lifting operation.

SUMMARY OF THE DISCLOSURE

Embodiments disclosed herein may provide an audible alarm system for preventing damage as a result of engaging or moving tubular members, the system including a lifting device configured to engage and move a tubular member; an operator configured to couple to the lifting device and the tubular member, whereby a force of a lifting operation is applied to the operator when the lifting device engages and moves the tubular member, and wherein the operator is provided with a predetermined set-point that corresponds to a weight associated with at least one of the tubular member, the lifting device, and combinations thereof; and an audible device operatively engaged with the operator, wherein the audible device produces an audible alarm when the force of the lifting operation exceeds the predetermined set-point, thereby providing the alarm to prevent damage as a result of engaging or moving the tubular member.

Other embodiments may include audible alarm system for preventing damage due to improper alignment, engagement, or lifting of tubular members. The system may include a lifting device configured to engage and lift a tubular member; an operator secured to the lifting device and the tubular member, wherein a weight of a lifting operation is applied to the operator when the lifting device engages and pulls the tubular member, and wherein the operator is provided with a preselected force corresponding to a weight associated with the tubular member, a maximum weight of the lifting device, or combinations thereof; a sensing device secured to the lifting device and configured to detect a position of the tubular member relative to the lifting device; a first audible device operatively engaged with the operator, wherein the first audible device produces a first audible alarm when the weight of the lifting operation exceeds the preselected force for preventing improper lifting of the tubular member; and a second audible device operatively engaged with the sensing device, wherein the second audible device produces a second audible sound when the sensing device detects the selected position of the tubular member for preventing improper alignment between the lifting device and the tubular member.

The present disclosure may also include embodiments that provide a method for preventing damage during lifting or engagement of tubular members. The method may include the steps of providing an operator, wherein the operator is configured with a predetermined set-point that corresponds to a weight associated with a tubular member; coupling the operator and a lifting device to the tubular member; initiating a lifting operation with the lifting device, wherein a weight of the lifting operation is applied to the operator; and setting an audible device to provide an audible alarm when the weight of the lifting operation exceeds the predetermined set-point to thereby prevent damage during lifting of the tubular member.

Further embodiments may include a method for preventing damage as a result of lifting, engagement, or alignment of tubular members. The method may include the steps of providing an operator with a predetermined set-point that corresponds to a weight associated with a tubular member; initiating an operation to engage the tubular member with a lifting device; detecting a position of the tubular member relative to the lifting device; providing an audible sound when the tubular member occupies the selected position, whereby the sound provides a warning to prevent improper alignment between the lifting device and the tubular member; coupling the operator and the lifting device to the tubular member; initiating a lifting operation with the lifting device, wherein a force associated with the lifting operation is applied to the operator; and setting an audible device to provide an audible alarm when the force of the lifting operation exceeds the predetermined set-point to thereby prevent damage during lifting of the tubular member.

BRIEF DESCRIPTION OF THE DRAWINGS

In the detailed description of various embodiments useable within the scope of the present disclosure, presented below, reference is made to the accompanying drawings, in which.

Figure 1:
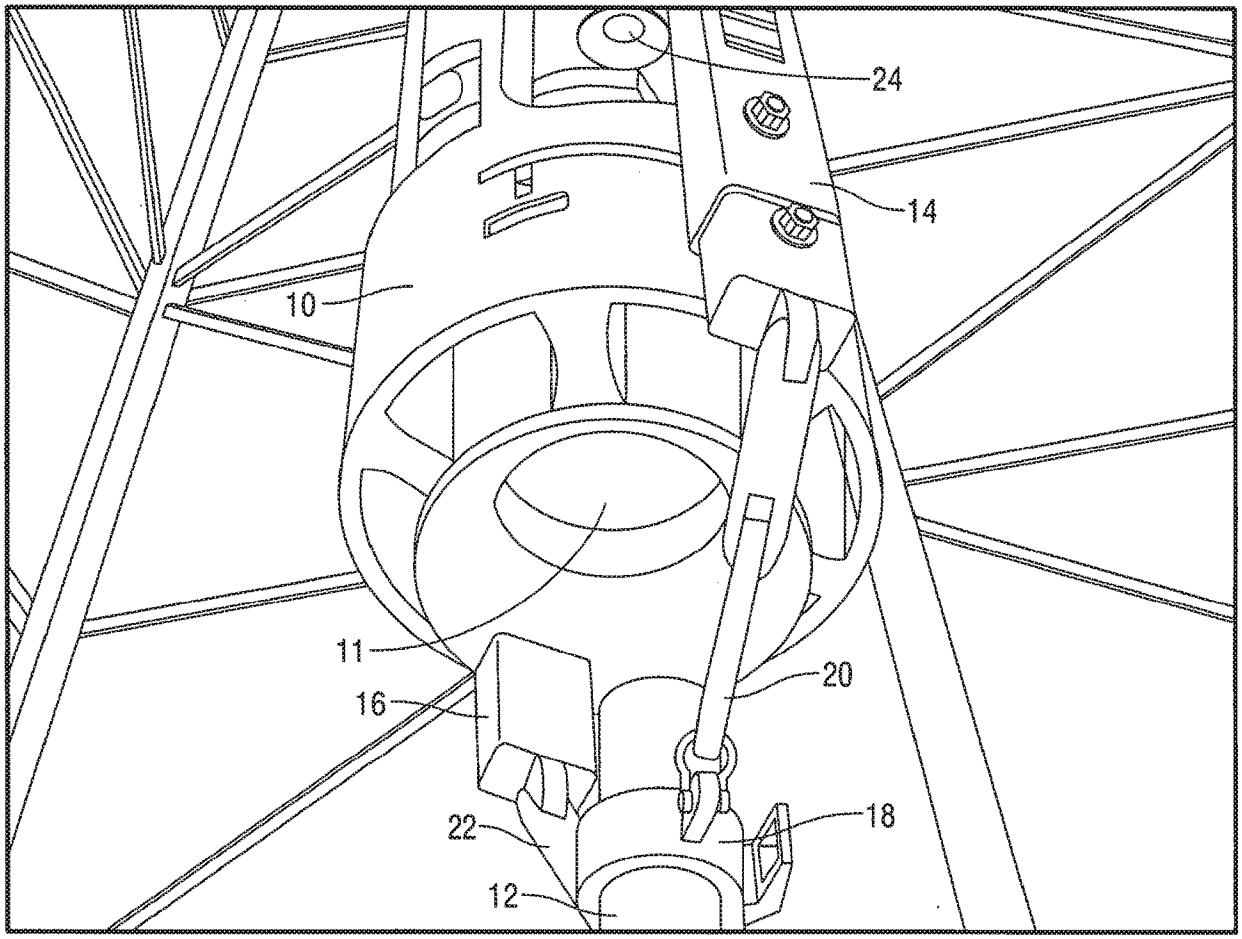
FIG. 1 depicts a perspective view of an embodiment of a system usable within the scope of the present disclosure.

One or more embodiments are described below with reference to the listed Figures.

DETAILED DESCRIPTION OF THE EMBODIMENTS

Specific embodiments of the present disclosure will now be described in detail with reference to the accompanying Figures. Like elements in the various figures may be denoted by like reference numerals for consistency. Further, in the following detailed description of embodiments of the present disclosure, numerous specific details are set forth in order to provide a more thorough understanding of the invention. However, it will be apparent to one of ordinary skill in the art that the embodiments disclosed herein may be practiced without these specific details. In other instances, well-known features have not been described in detail to avoid unnecessarily complicating the description.

In addition, directional terms, such as "above," "below," "upper," "lower," etc., are used for convenience in referring to the accompanying drawings. In general, "above," "upper," "upward," and similar terms refer to a direction toward the earth's surface from below the surface along a wellbore, and "below," "lower," "downward," and similar terms refer to a direction away from the surface along the wellbore (i.e., into the wellbore), but is meant for illustrative purposes only, and the terms are not meant to limit the disclosure.

Embodiments described herein relate to alarm systems and methods for preventing improper lifting of tubular members, and particularly audible alarm systems.

In one embodiment, an audible alarm system may be used in conjunction with a lifting device usable to engage and maneuver a tubular member. For example, a casing running tool, such as the CRT-350, produced by National Oilwell Varco, may be provided for engagement with and assembly or disassembly of one or more segments of casing. While any type of lifting device is usable within the scope of the present disclosure, in a particular embodiment the lifting device may include an internal bore for receiving the tubular member, and a slip or similar gripping member for engaging the tubular member once it is received and properly positioned within the internal bore.

A sensing device may be disposed within the internal bore or otherwise secured to the lifting device, for detecting the tubular member when the tubular member achieves a selected position suitable for engagement by the lifting device. For example, the tubular member may contact a mechanical member positioned within the lifting device. Alternately or additionally, a laser device, electronic position sensor, motion detector, or similar device known in the art may be used to determine when the tubular member reaches a selected position relative to the lifting device.

Responsive to detection of the tubular member by the sensing device, an audible device, such as a pneumatic horn and/or an air horn, may be actuated to produce an audible sound, to immediately alert the operator of the lifting device, and/or other personnel at a work site. It should be appreciated that other types of alarm devices are also readily usable with various embodiments of the present disclosure, such as by way of example, lights. Continued motion of the lifting device may thereby be immediately ceased, preventing improper contact between the lifting device and the tubular member, an improper engagement therebetween, or other potential sources of damage.

Once the lifting device has been engaged with a tubular member, one or more operators, such as for example a cylinder, secured to or otherwise provided in operative association with the lifting device may also be engaged with the tubular member. Thus, when a lifting operation is performed, the weight of the lifting operation is applied to the operator. For example, two fluid and/or gas cylinders, which may include hydraulic or pneumatic cylinders, may be provided on opposing sides of the lifting device, or alternately, a spring or other mechanical biasing member may be used. A collar, single joint elevator, or similar gripping device secured to the one or more operators may be placed around the tubular member. The cylinders or other operators may be provided with a preselected force and/or a known load corresponding to the weight of a single tubular member, the maximum weight capacity of the lifting device, or the maximum weight capacity of an elevator or spider used in conjunction therewith.

When a lifting operation is performed, the weight of the tubular member is first provided to the one or more operators. The preselected force of the one or more operators resists the weight of the lifting operation, such that if the weight of the lifting operation is less than the preselected force, the lifting operation may occur uninterrupted. If the weight of the lifting operation exceeds the preselected force, which may readily occur if multiple connected tubular segments are inadvertently lifted, an audible device, such as an air horn and/or a pneumatic horn, engaged with the operator, may provide an audible alarm to alert the operator of the lifting device and/or other personnel at the work site. The improper lifting operation may thereby be immediately halted before damage is incurred to the tubular members or lifting equipment.

Referring now to FIG. 1, an embodiment of a system usable within the scope of the present disclosure is shown. The depicted system includes a lifting device (10), which may be, for example, a casing running tool, normally used in conjunction with a single joint elevator or similar gripping device, to handle, torque, and maneuver a tubular member (12). The lifting device (10) includes an internal bore (11) and a gripping device (not visible in FIG. 1). It should be understood that while FIG. 1 depicts a casing running tool, other embodiments of the system may be used with any type of lifting device, adapted to lift or otherwise move any type of tubular member or other object.

A first operator (14) and a second operator (16) are shown secured to opposing sides of the lifting device (10). The first operator (14) may also be secured to the tubular member (12) using a first pivotable arm (20), which may be engaged with a collar (18) that may be disposed about the tubular member (12). Similarly, the second operator (16) may be secured to the tubular member using a second pivotable arm (22) secured to an opposing side of the collar (18). During typical operations, the collar (18) may include any manner of gripping and/or lifting device, including without limitation a single joint elevator or other type of elevator, a spider, a tong, or other similar devices.

The operators (14, 16) are shown as fluid cylinders, which may include hydraulic, pneumatic, and/or other fluid or gas cylinders, as known in the art, enclosed within a movable housing, which is described in greater detail below. The operators (14, 16) may be adjustable or otherwise able to be provided with a predetermined set-point, such as a preselected force, weight, etc. Alternatively, the operators may have a known load and/or force, such that when weight is applied to the operators (14, 16) during lifting of the tubular member (12), if the weight exceeds the predetermined set-point or known load of the operators (14, 16), the movable housing will be pulled toward an extended position, and an internal or external sensor (not shown) will be actuated. It should be understood that the sensor within or otherwise associated with the operators (14, 16) may include any manner of contact switch, position detector, electric, hydraulic, pneumatic, or mechanical switch or detector, or combinations thereof, as known in the art. An audible device (24), shown as an air horn, may be provided in operative communication with the sensor, such that responsive thereto, the audible device (24) will produce an audible alarm to attract the immediate attention of the operator and/or other personnel at a work site.

As an example, the predetermined set-point and/or known load of the operators (14, 16) may correspond to the weight of a single tubular member, such that if a single tubular member is lifted, the predetermined set-point is not exceeded, and the sensor within or otherwise operatively associated with the operators (14, 16) is not actuated. However, if, for example, multiple connected tubular members are lifted, the predetermined set-point may be exceeded, which may cause the sensor to actuate, and the audible device (24) to thereby sound, such that the work site operator and/or personnel may be alerted and the lifting operation may be immediately halted.

Figure 2:
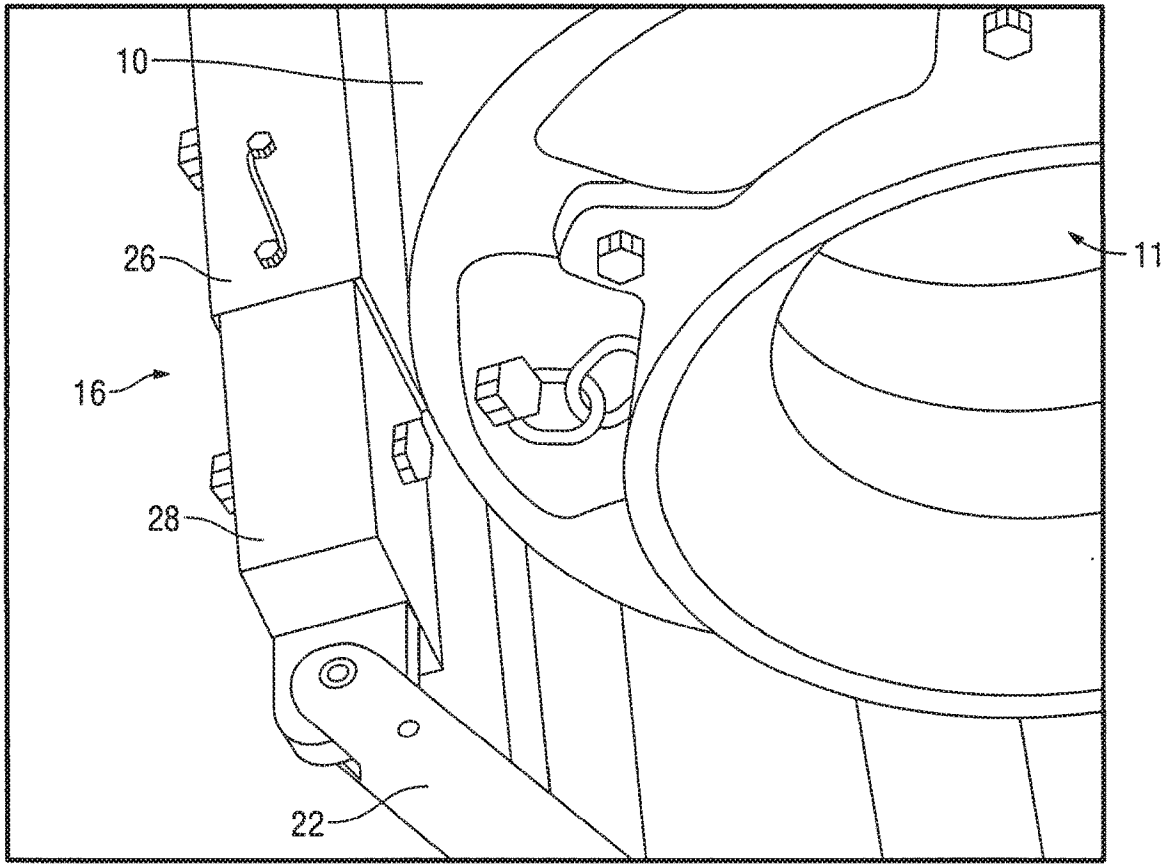
FIG. 2 depicts a detail view of an operator of the system of FIG. 1 in a retracted position.

Referring now to FIG. 2, an enlarged view of the second operator (16) is shown, engaged with the lifting device (10), and with the tubular member via the second pivotable arm (22). FIG. 2 depicts the second operator (16) including an upper section (26) and a lower section (28), telescopingly engaged over a central section (not visible in FIG. 2). Weight from the tubular member may be applied to the second operator (16) during a lifting operation. In an embodiment, during the lifting operation the lower section (28) may be configured to move in a downward direction and/or away from the upper section (26), while the predetermined set-point of the second operator (16) may also resist against weight applied to the operator (16). However, if the weight, for example, of the tubular member, exceeds the predetermined set-point of the second operator (16), the lower section (28) may extend away from the upper section (26), and the sensor within the second operator (16) may actuate.

Figure 3:
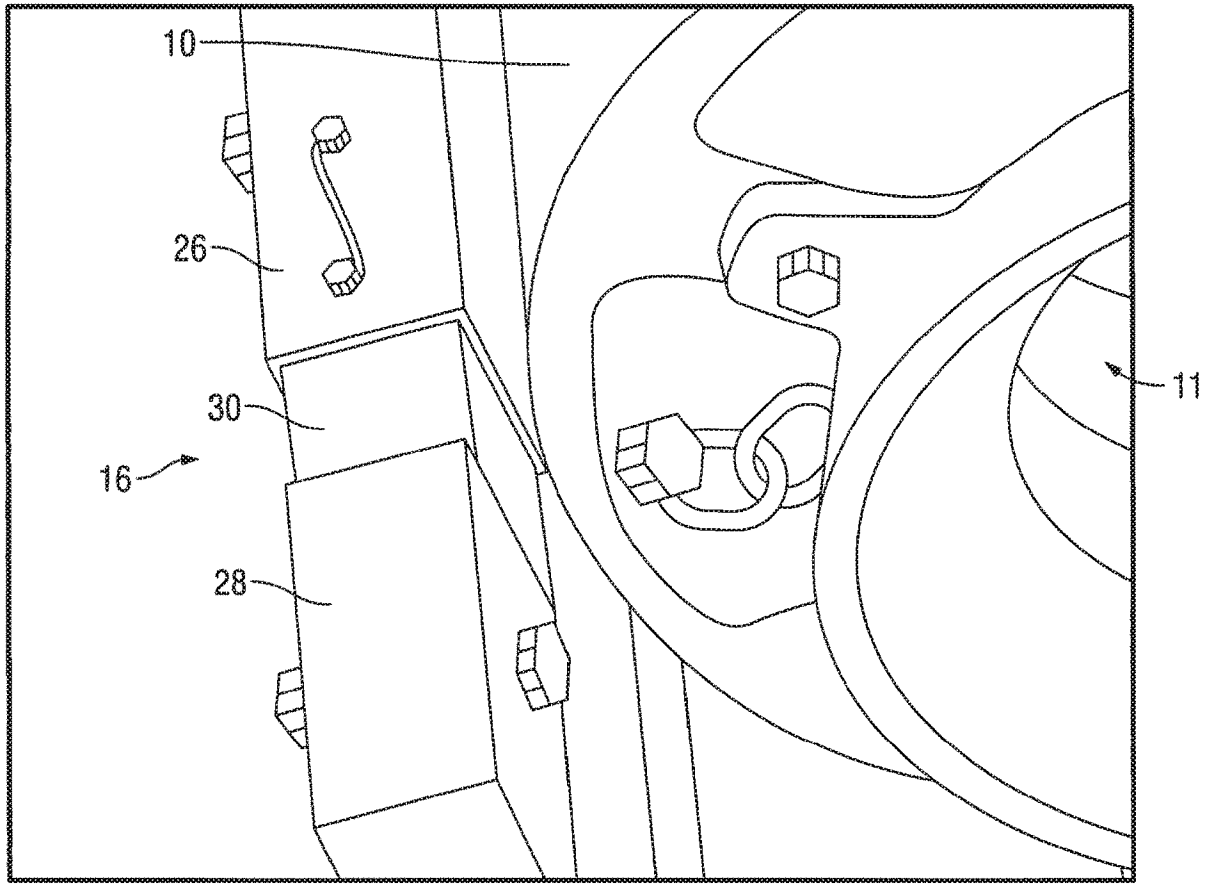
FIG. 3 depicts a detail view of an operator of the system of FIG. 1 in an extended position.

FIG. 3 depicts the lifting device (10) in association with the second operator (16) in an extended position. In one embodiment, the force associated with a lifting operation, which may include weight, may pull the lower section (28) apart from the upper section (26), such that the central section (30) may be visible.

Figure 4:
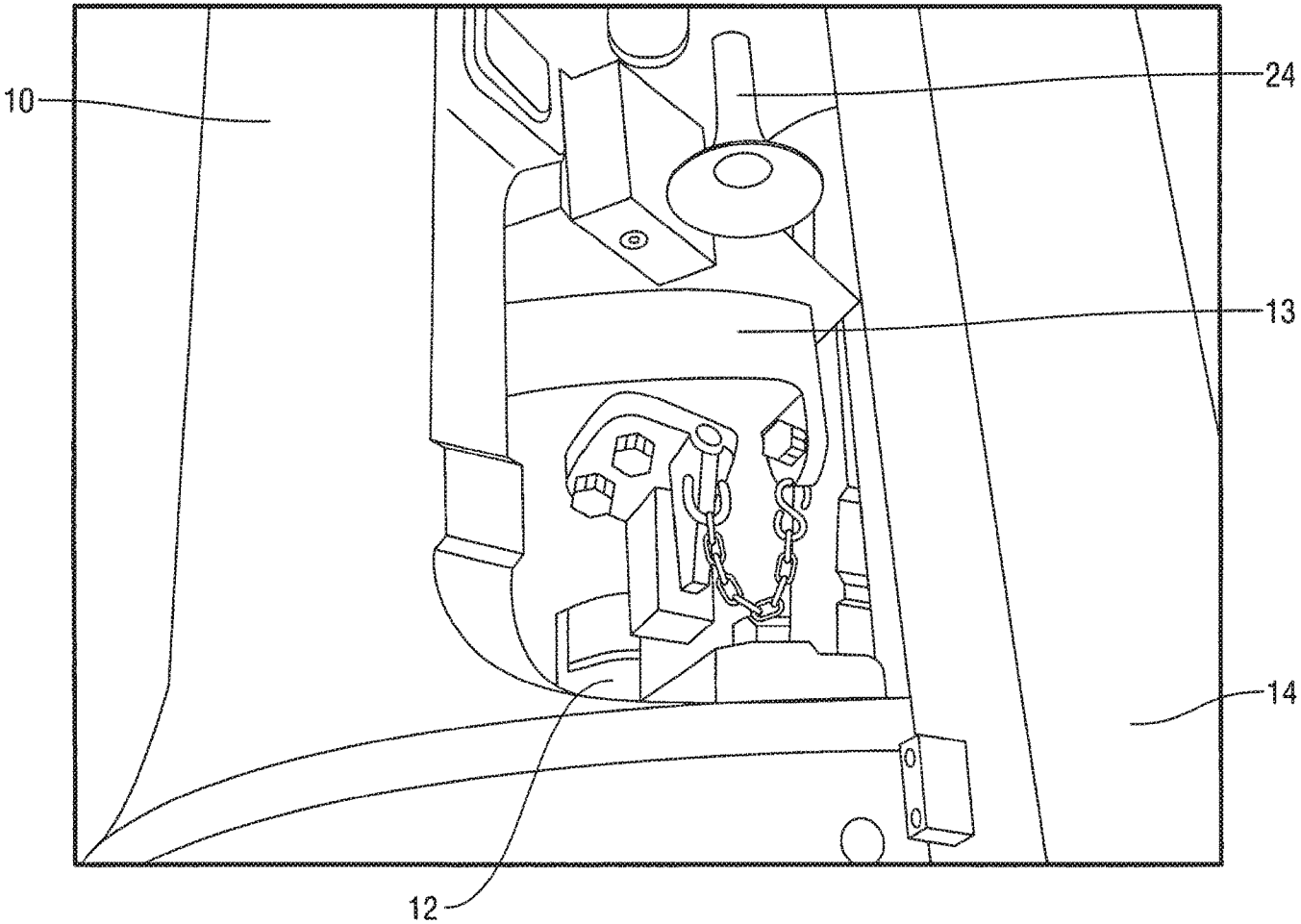
FIG. 4 depicts a perspective view of an embodiment of a system usable within the scope of the present disclosure prior to engagement of a tubular member.

Referring now to FIG. 4, a view of a lifting device (10) prior to engagement with a tubular member (12) in accordance with embodiments disclosed herein, is shown. The tubular member (12) may be inserted within the internal bore of the depicted lifting device (10), whereby a gripping member (13), which may include any manner of slips, rings, collars, seals, or other gripping and/or lifting devices as known in the art, may be usable to engage the tubular member (12). In an embodiment, the gripping member (13) may be configured to automatically engage the tubular member (12) once the tubular member (12) has reached a selected position within the interior of the lifting device (10).

In operation, there may be a possibility that a user may inadvertently maneuver the lifting device (10) and/or the tubular member (12) after the tubular member (12) reaches a position suitable for engagement, which may cause an impact between the lifting device (10) and the tubular member (12), and may also cause an improper engagement. As such, the system may also include a sensing device (not visible in FIG. 4) that may be configured to detect the position of the tubular member (12). For example, a mechanical member adapted to contact the tubular member (12) when the tubular member (12) reaches a position suitable for engagement by the lifting device (10) may be provided. Other sensing devices, such as electrical devices, laser devices, motion sensors, and similar devices known in the art are also usable. Responsive to detection by the sensing device, a horn or similar audible device, which may include the audible device (24) or a second audible device, may produce an audible sound (i.e., warning signal, caution alarm, etc.) to alert an operator and/or other individuals at a work site.

Figure 5:
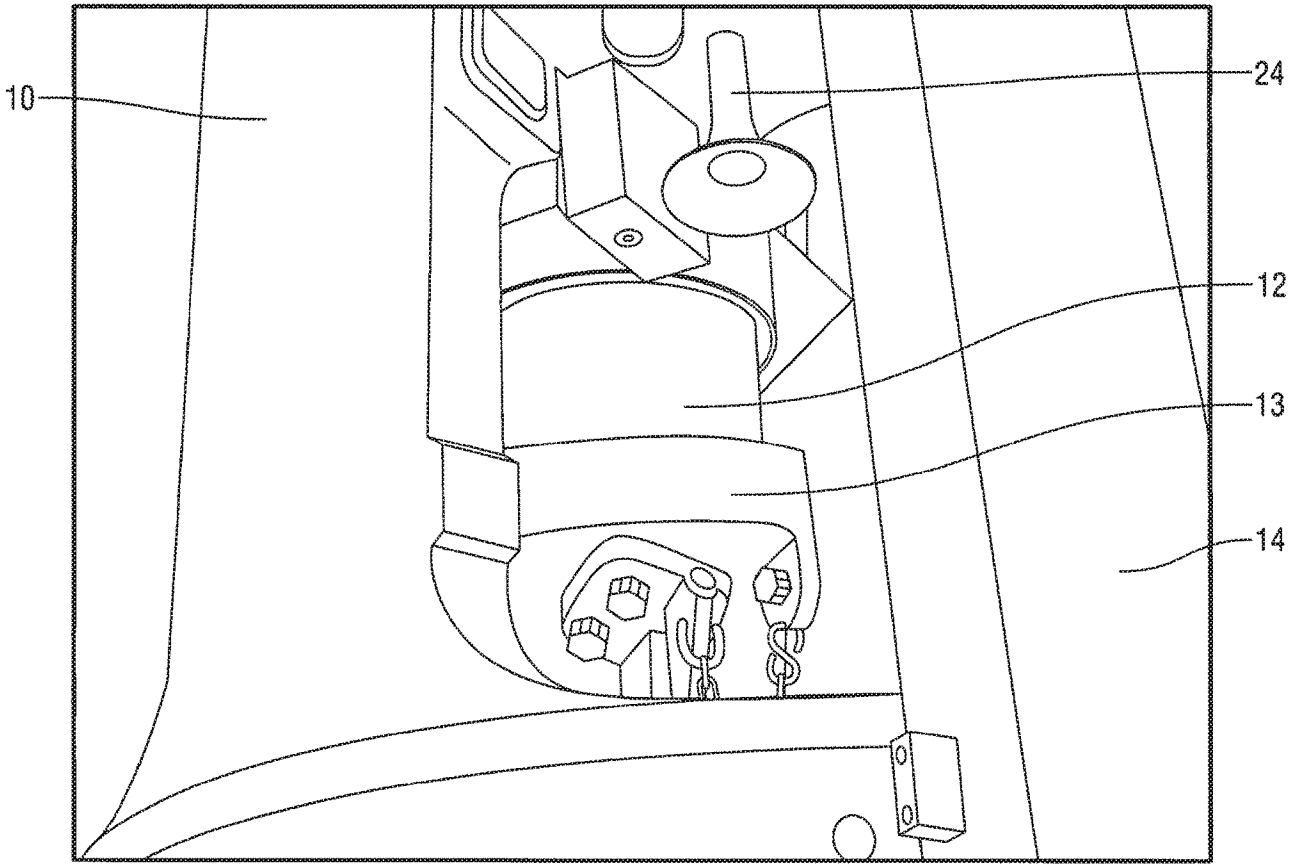
FIG. 5 depicts the system of FIG. 4 after engagement of the tubular member.

FIG. 5 illustrates an example of the lifting device (10) of FIG. 4 after the gripping member (13) has moved to engage the tubular member (12). As described previously, movement of the gripping member (13) may occur automatically after the tubular member (12) reaches a selected position within the lifting device (10), while additional movement after the tubular member (12) has reached this position may be prevented through actuation of an audible device (24). An operator (14), as described previously, is also shown engaged to the lifting device (10).

Figure 6:
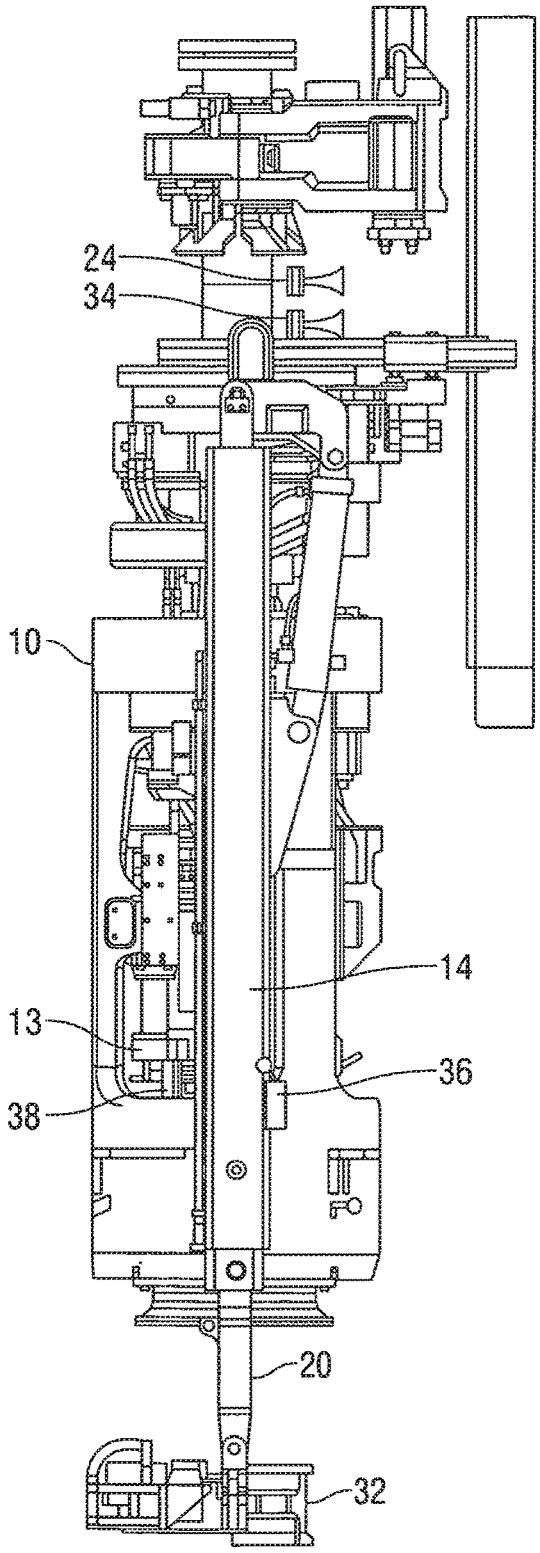
FIG. 6 depicts a diagram of an embodiment of a system usable within the scope of the present disclosure.

Referring now to FIG. 6, a diagram of an embodiment of a system usable within the scope of the present disclosure is shown. Specifically, a lifting device (10) configured to engage tubular members using a gripping member (13), as described previously, is shown. Within an internal bore of the lifting device (10), proximate to the gripping member (13), a sensing device (38) is shown, which may determine a position of a tubular member within the lifting device (10) when contacted by the tubular member. Responsive to output from the sensing device (38), a pneumatic horn (34) or similar audible device may be actuated, such that an operator may immediately halt movement of the lifting device (10) and/or the tubular member when the tubular member occupies a position suitable for engagement.

An operator (14) may be engaged to the lifting device (10), as described previously, the operator (14) being operatively connected to a single joint elevator (32) or similar lifting device by a pivotable arm (20). A sensing device (36) may be disposed on the operator (14) for determining when a weight applied to the operator (14) during lifting of a tubular member engaged by the lifting device (10) and/or the single joint elevator (32) exceeds a preset force or known weight of the operator (14). Responsive to output from the sensing device (36), an audible device (24) may provide an audible alarm when the preselected force of the operator (14) is exceeded, as described previously, such that an operator may immediately halt an improper lifting operation that could potentially damage the tubular member, lifting device (10), single joint elevator (32) or other equipment.

Each of the depicted audible devices (24, 34) may include separate pneumatic and/or air supplies, and may produce sounds that are readily able to be differentiated, such that operators and/or other individuals at a work site may remain contemporaneously aware when a tubular member reaches a selected position within the lifting device (10) and/or when a lifting operation that exceeds the preselected force of the operator (14) is initiated.

While various embodiments useable within the scope of the present disclosure have been described with emphasis, it should be understood that within the scope of the appended claims, the present disclosure may be practiced other than as specifically described herein.

What is claimed:

1. An audible alarm system for preventing damage as a result of lifting tubular members at a work site comprising:

a) a casing running tool configured to engage and lift a tubular member;

b) a single joint elevator configured to engage and lift a tubular member;

c) at least one telescoping operator having a first end and a second end, wherein said first end is operatively connected to said casing running tool and said second end is operatively connected to said single joint elevator, wherein a weight of said tubular member is applied to said at least one telescoping operator when said single joint elevator engages and lifts a tubular member, and wherein said at least one operator is provided with a predetermined set-point corresponding to a lifting capacity of said single joint elevator; and d) an audible device operatively engaged with said operator, wherein said audible device is adapted to produce an audible alarm sound to alert personnel at said work site when said weight applied to said at least one operator exceeds said predetermined set-point and pulls said at least one telescoping operator from a first retracted position to a second extended position.

2. The audible alarm system of claim 1, wherein said casing running tool has an internal bore for receiving said tubular member and a gripping member for engaging said tubular member when said tubular member is received in said internal bore.

3. The audible alarm system of claim 1, wherein said audible device comprises a horn.

4. The audible alarm system of claim 2, further comprising:

a) a sensing device for detecting a selected position of said tubular member within said internal bore of said casing running tool; and b) a second audible device operatively engaged with said, wherein said second audible device produces a second audible alarm when said sensing device detects a selected position of said tubular member relative to said casing running tool.

5. The audible alarm system of claim 4, wherein said second audible device comprises a horn.

6. The audible alarm system of claim 1, wherein said at least one telescoping operator comprises at least one of a hydraulic cylinder, a pneumatic cylinder, a mechanical biasing member, and combinations thereof.

7. An audible alarm system for preventing damage from improper lifting of tubular members at a work site comprising:

a) a casing running tool configured to engage and lift a tubular member;

b) a single joint elevator configured to engage and lift a tubular member;

c) at least one telescoping operator operatively connecting said casing running tool to said single joint elevator, wherein a weight of a tubular member is applied to said at least one telescoping operator when said single joint elevator engages and lifts said tubular member, and wherein said at least one telescoping operator is adapted to alternate between a first retracted position and a second extended position when said weight applied to said at least one telescoping operator exceeds said predetermined set-point and pulls said at least one telescoping operator to said second extended position;

d) a sensing device for detecting when said at least one telescoping operator is in said second extended position; and e) an audible device operatively engaged with said sensing device, wherein said audible device is adapted to produce an audible alarm sound to alert personnel at said work site when said at least one telescoping operator is in said second extended position.

8. The audible alarm system of claim 7, wherein said sensing device comprises at least one of a contact switch, position detector, electric switch, hydraulic switch, pneumatic switch, mechanical switch, and combinations thereof.

9. The audible alarm system of claim 7, wherein said at least one telescoping operator comprises at least one of a hydraulic cylinder, a pneumatic cylinder, a mechanical biasing member, and combinations thereof.

10. The audible alarm system of claim 7, wherein said casing running tool has an internal bore for receiving said tubular member and a gripping member for engaging said tubular member when said tubular member is received in said internal bore.

11. The audible alarm system of claim 10, further comprising a second sensing device for detecting a selected position of said tubular member within said internal bore of said casing running tool.

12. The audible alarm system of claim 11, further comprising a second audible device operatively engaged with said second sensing device, wherein said second audible device produces a second audible alarm when said second sensing device detects a selected position of said tubular member relative to said casing running tool.

13. A method for preventing damage during lifting of tubular members at a work site, the method comprising the steps of:

a) providing at least one telescopically extendable operator that operatively connects a casing running tool to a single joint elevator, wherein said at least one telescopically extendable operator is configured with a predetermined set-point corresponding to a lifting capacity of said single joint elevator;

b) coupling said single joint elevator to a tubular member;

c) initiating a lifting operation, wherein a weight of said tubular member is lifted by said single joint elevator;

d) providing a sensing device connected to said at least one telescopically extendable operator which detects when the weight of said tubular member applied to said telescopically extendable operator during said lifting operation pulls said telescopically extendable operator from a first retracted position to a second extended position corresponding to said predetermined set-point; and e) communicating an output from said sensing device to an audible device to provide an alarm to alert personnel at said work site that the telescopically extendable operator has been pulled from a first retracted position to a second extended position.

14. The method of claim 13, wherein said audible device comprises a horn.

15. The method of claim 13, further comprising a sensing device, operatively engaged with said audible device, for detecting when said telescopically extendable operator is in said second extended position.

16. The method of claim 15, wherein said telescopically extendable operator comprises at least one of a hydraulic cylinder, a pneumatic cylinder, a mechanical biasing member, and combinations thereof.

17. The method of claim 13, further comprising the step of receiving said tubular member within an internal bore of said casing running tool and engaging a gripping member of said casing running tool to grip said tubular member.

18. The method of claim 17, further comprising the steps of:

a) detecting a selected position of said tubular member within said internal bore; and b) providing a second audible sound if said tubular member occupies said selected position.

* * * * *